United States Patent [19]

Sarracino

[11] 4,322,941

[45] Apr. 6, 1982

[54] WIRE STRANDING MACHINE WITH MULTIPLE BOBBINS ALTERNATELY LOADED AND USED FOR STRANDING

[75] Inventor: Marcello Sarracino, Milan, Italy

[73] Assignee: Industrie Pirelli S.p.A., Milan, Italy

[21] Appl. No.: 199,423

[22] Filed: Oct. 22, 1980

[30] Foreign Application Priority Data

Oct. 31, 1979 [IT] Italy ..... 26952 A/79

[51] Int. Cl.[3] ..... D07B 3/04

[52] U.S. Cl. ..... 57/16; 57/17; 57/313

[58] Field of Search ..... 57/13–18, 57/313

[56] References Cited

U.S. PATENT DOCUMENTS 1,513,583 10/1924 Conner ..... 57/16 X
2,079,433 5/1937 Cobb ..... 57/16
2,826,035 3/1958 Cogger ..... 57/17
3,570,233 3/1971 Nalpas et al. ..... 57/16

*Primary Examiner*—John Petrakes
*Attorney, Agent, or Firm*—Brooks, Haidt, Haffner & Delahunty

[57] ABSTRACT

A stranding machine comprising a plurality of stands, each carrying a pair of bobbins disposed on opposite sides of the stand, wire on a bobbin being fed through a hollow, rotatable shaft on the stand along with a core, such as an electric cable core, and to a stranding unit. The number of stands is equal to the number of wires to be stranded, and each stand carries means for paying-off wire from either bobbin and means for loading either bobbin with wire, the wire guiding means of the latter being movable from adjacent one bobbin to adjacent the other bobbin, whereby one bobbin may supply the wire for stranding while the other bobbin is being loaded with wire. Drive means, separate from means which rotates the hollow shaft, rotates the bobbin being loaded and can drive either bobbin.

14 Claims, 5 Drawing Figures

WIRE STRANDING MACHINE WITH MULTIPLE BOBBINS ALTERNATELY LOADED AND USED FOR STRANDING

The present invention relates to machines for stranding several wires together or for stranding several wires around a central core, such as, for example, a rope, the conductor of an electric cable, or similar elements of considerable length, which are progressively moved in the direction of their axes.

More precisely, the invention relates to a stranding machine of the type with central bobbins, which machine substantially comprises a plurality of hollow shafts aligned with one another and each of which is free to rotate about a central support and is rotatable by an appropriate motor, a pair of bobbins, representing by themselves constructional elements of the machine having a fixed position, said bobbins being mounted for rotation on the shaft at opposite sides of the support and being alternatively used to strand or to wind-up new wire, and a pair of paying-off elements, or wire-decoiling arms, provided with suitable driving pulleys.

In these machines, during the stranding operation, the wires of one of the bobbins of all the pairs rotatably mounted on each shaft are progressively payed-off by means of their associated, adjacent decoiling element secured to the rotating shaft for rotation therewith and, by a system of pulleys, are fed through the plurality of hollow shafts to the stranding station under a tensioning action carried out by appropriate tensioning means.

The second bobbins of the various pairs, adjacent to the first bobbins on the same shaft used in the stranding phase, are rotated, in turn by other driving means and are reloaded with further turns of wire to be subsequently used for stranding when the wire from first adjacent bobbins are exhausted.

It can be easily understood that the above-mentioned stranding machines have an increased output in comparison with those in which the empty bobbins are removed from the shaft to allow the insertion of loaded bobbins. In fact, in said machines, owing to the lack of eccentricy of the pairs with respect to the axis of rotation of the machine, high speeds can be foreseen and there are no idle times due to the removal of bobbins from the shaft and to the insertion of new bobbins thereon.

However, from experiments, it has been noted that the above-described solution, while sufficiently satisfactory, can be further improved and thereby solve some problems in a more complete way.

A first problem concerns the difficulty of guiding the wire to be wound-up in a position very near to its respective bobbin on account of the overall size of the possible driving means to be adopted and of the size of the decoilers.

This dependence between the means for guiding the wire towards the winding-up bobbin and the radially outermost parts of the machine represents an undesired characteristic, since it was noted that the regular laying of the wire turns forming a new coil, the regular paying-off of the wire, and consequently, the correct operation of the machine in the subsequent stranding phase, are improved if the wire is appropriately guided at a position in proximity to its associated winding-up bobbin.

In a certain sense, the solution of this problem is still more difficult because the wire decoiling elements, during the stranding phase, allow a drawing of the wire from its coil which is the easier the greater the distance between the wire guiding pulley carried by the decoiling apparatus and the axis of the stranding bobbin. It is evident that this geometrical condition, in consequence of the increased radial overall dimension of the paying-off element, is in contrast with the desired approach of the wire guiding means to the winding-up bobbin.

A further problem concerns the actuation of one group of bobbins of the machine during the winding-up phase, which is to be simultaneous with the stranding phase of the adjacent group of bobbins of the various pairs.

To give an idea of the complexity of the problem, it is pointed out that the problems with the simplest solution of making use of the rotational motion of the main shaft of the machine to rotate the empty bobbins to be loaded with the wire are not so obvious as to be apparent at first sight. In fact, according to said solution, the transmission of motion should start from the shaft portion not occupied by the bobbins, namely, that situated in the central support and hence, through gears and coupling systems of any kind, it should be directed to an auxiliary shaft extending parallel to the main shaft and connected at its free end, by means of a second belt drive, to a lateral flange of the bobbin to be reloaded with new wire.

In practice, according to said solution, the mechanism formed by the auxiliary shaft and the relative supporting structure with the bearings, in order not to interfere with the disc supporting the wire decoiling arm, normally situated between the central support and the bobbin, should be displaced in a radially outer position with respect to the machine parts rotating during the stranding phase, with the risk, to avoid any mechanical interference, of moving the wire guiding system to a more radially outer position during the winding-up phase, resulting therefore, in the above-mentioned disadvantageous condition, which would thereby become worse.

It will be apparent that the attempt of finding a good arrangement, in which the machine parts effecting the stranding and winding operations do not mutually interfere, involves further problems, needing a solution.

The present invention has, as one object, the provision of a stranding machine having central bobbins rotatable in permanent positions on their respective shafts and used to strand and to wind-up new wire, which is able to solve all of the abovedescribed problems and to ensure a correct performance in both the stranding and winding-up phases.

Accordingly, the object of the present invention is to provide a stranding machine for several wires which comprises a plurality of hollow shafts aligned to one another, each of which can freely rotate in a central support and is rotatable by an appropriate motor, a pair of bobbins rotatably mounted on the shaft at the opposite sides of the support and used alternatively to strand and to wind up new wire, and a pair of discs rotatably mounted on the shaft at the opposite sides of the support in an axially inner position with respect to the bobbins, each disc comprising a respective paying-off element or decoiling arm and an end pulley to feed the wire payed-off from the bobbin towards the interior of the hollow shaft where it is subjected to tension and is pulled inside said group of shafts towards the stranding station. The stranding machine is characterized in that it comprises only one dispenser for the wire to be alternatively supplied to either bobbin of said pair and a system for imparting rotation to the bobbin of each pair in the winding up phase, said dispenser comprising an arm movable in two directions parallel to the bobbin axis between two planes defined by the bobbin flanges, an end pulley on said arm and intended to guide the wire, being fed to a bobbin, and means for moving said arm in alternatively opposite directions from one plane defined by the bobbin flanges to the other, the pulley being displaceable between two planes orthogonal to the bobbin axes by rotating the arm about an axis at its end opposite to the end thereof carrying the pulley and the last-mentioned axis being contained in a plane between the discs which is orthogonal to the shaft. The driving system comprises a central shaft mounted on the support by suitable bearings and rotatable by actuating means, two lateral shafts mounted for rotation in the bodies of the discs, the central shaft comprising means for its temporary connection with the adjacent ends of the lateral shafts mounted on the discs, means for connecting said lateral shafts to the bobbins, and means for aligning the lateral shafts and the central shaft.

The main features of the invention are, therefore, three. The first concerns the presence of only one wire dispenser for two bobbins, with an arm and an associated end pulley rotatable about a rotation center between the two discs. The second relates to the system for actuating the winding-up bobbins, which comprises a group of shafts one of which is rotatable on the central support and the others of which are rotatable on the discs, and the third relates to the means for aligning the central shaft and the lateral shafts on the discs. As it will be evident from the following description, the simultaneous presence of these three features permits a satisfactory operation of the machine both in the stranding and in the winding-up phase.

According to a preferred embodiment, in the machine of the invention, the actuation of the winding-up bobbins is distinct from the driving of the main shaft. Therefore, in this case, the stranding machine is characterized by the fact that it comprises, for each pair of bobbins, a motor associated to parts of the support and means for connecting said motor to the central shaft.

Further, the stranding machine is preferably characterized in that the central shaft imparts motion both to the bobbins in the winding-up phase and to the means for moving the paying-off arm of the dispenser.

The movable arm of the dispenser can be oriented in various ways. In one of these ways, the stranding machine is characterized in that said arm is connected to a sleeve slidable in opposite senses on a guiding bar whose ends are fixed on structures sustaining the support and between the discs. In the one way, the stranding machine is characterized in that the arm of the dispenser is cantilevered on a collar freely rotatable about a pin secured to said sleeve.

Other objects and advantages of the present invention will be apparent from the following detailed description of the presently preferred embodiments thereof, which description should be considered in conjunction with the accompanying drawings in which.

Figure 1:
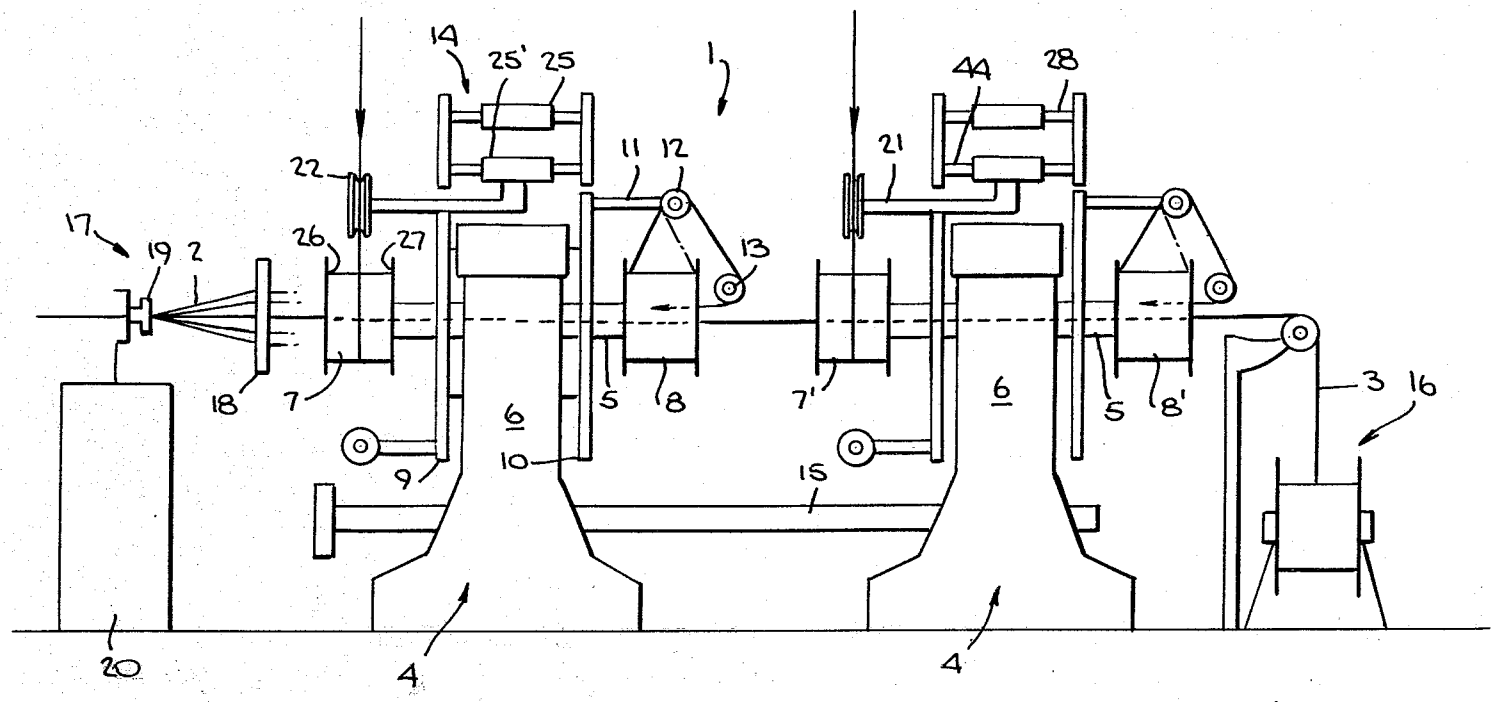
FIG. 1 is a schematic, side elevation view of the machine in which view, for simplicity's sake, only two pairs of bobbins are represented.

The invention is applicable to machines for making onelayer strands or several layer strands having alternate senses and/or different pitches.

The following description relates to an embodiment of the invention and, for example, includes a machine 1 (FIG. 1) used to strand several metal wires 2 about a central core 3, e.g., to form a screening about the central core 3 which may be the conductor and associated insulation, of a power cable.

The machine 1 comprises several units whose number is equal to the number of the wires 2 to be stranded. Each of said units (FIG. 2) comprises a hollow shaft 5, free to rotate on a central support 6, a pair of bobbins 7 and 8 mounted to rotate on the shaft 5 at the sides of the support 6 and alternatively used either in the stranding or to wind-up a wire 2, a pair of discs 9 and 10 mounted to rotate on the shaft 3 at the sides of the support 6 and in an axially inner position with respect to the bobbins 7 and 8 and a paying-off element or decoiling arm 11 transported by each disc 9 and 10 and with its associated pulley 12. The paying-off element 11 pays off the wire from a bobbin 7 and 8, and the wire is guided by means of a further pulley 13 secured in fixed relation to the rotatable shaft 5. A single dispenser 14 (FIGS. 1 and 3) supplies the wire alternatively to either bobbin of the pair of bobbins 7 and 8 and the machine 1 comprises a system for imparting motion to the bobbins 7 and 8 in the winding-up phase, which system is illustrated in detail in FIGS. 2 and 3.

The units 4 of the machine 1, which for simplicity's sake are illustrated only by two thereof, have their respective shafts 5 aligned and separated in order to allow the advantageous connection between the terminal portion of the wire payed-off from bobbin 8, during the stranding phase, and the wire of the adjacent bobbin 7' of another unit 4 which is loaded by means of the dispenser 14 in said stranding phase.

An appropriate auxiliary shaft (FIG. 1), by way of gears 15' and 15'' (FIG. 2) and mounted on the support 6, rotates the shaft 5 and the discs associated therewith, as it will be explained hereinafter, during the stranding operation phase of the respective adjacent bobbins 8 and 7.

All the units 4 are situated (FIG. 1) between a core supplying stand 16 and a final station 17 which comprises a plate 18 provided with holes for the passage of the wires 2 and rotating together with the shaft of the last unit 4, a die 19 fixed on a base 20 and conventional tensioning and collecting means (not illustrated).

The wires 2 and the core 3 are guided inside the group of shafts 5 and are subjected to the tension exerted by the tensioning means, the tension on the wires being adjusted by braking means not illustrated as not forming part of the present invention.

It is to be understood that, if the machine 1 is used to manufacture strands formed by more than one layer, for example two layers, the units of the machine are divided into two groups, one for each layer, each group comprising units 4 having rotational senses and speeds which are equal or different, with respect to those of the units 4 of the other group, depending on whether the layers have alternate senses or not, each group being, moreover, provided with the respective perforated plate 18 and the thereto associated die 19.

The main parts of the machine of the invention, namely, the dispenser 14 for winding the wire on the bobbins 7 and 8, the system for imparting motion to the bobbins 7 and 8 in the winding-up phase, and the means for aligning the shafts which rotate the bobbins 7 and 8 in the winding-up phase in said driving system will now be described in detail.

Figure 4:
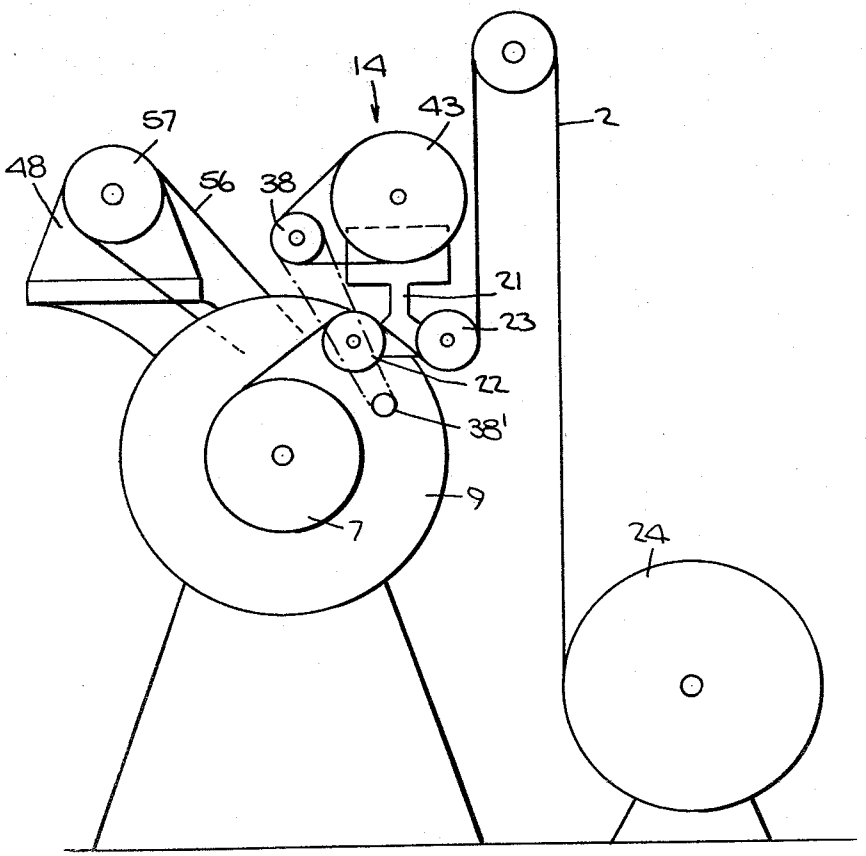
FIG. 4 illustrates the relative positions of the paying-off elements shown in FIG. 3 and a wire feeding drum in proximity to the machine of the invention.

The wire dispenser 14 comprises an arm 21 (FIGS. 3 and 4) movable in a horizontal plane and provided at its end with two guiding pulleys 22 and 23 (FIG. 4) which guide the wire 2 onto a bobbin 7 or 8, the wire 2 coming from a feeding drum 24, and comprises means for moving said arm 21 between the flanges 26,27 (FIG. 1) of a bobbin in either direction but in a direction parallel to the bobbin axis. Said arm moving means can be of various types, mechanical, or fluid operated with cylinders and associated pistons, connected in known ways to the arm 21 to control its motion in opposite directions parallel to the bobbin axis.

In the preferred embodiment of the invention, the means for moving the arm 21 comprises a device 25 able to transform a rotational motion into a rectilinear motion and further means 25' connected to said device 25 to impart said rectilinear motion to arm 21. The device 25 may be of any conventional type but, as an example, the shaft 28 can have a known type of self-reversing screw thread carrying a threaded nut 33 which is pushed by rotation of the shaft 28 towards one of the shaft ends and then is moved in opposite direction, the sense of rotation of the shaft 28 remaining unchanged, by the action of threads of contrary pitch and thereby, reverse the direction of movement of the nut 33.

Another device 25 which may be used comprises a smooth shaft 28 revolving about its own axis and a disc freely rotatable on an axis inclined with respect to the shaft 28 axis and having its periphery pushed by springs against the shaft 28, the disc axis being fixed with respect to an appropriate housing. In this case, the rotation of the shaft 28 compels the disc and its housing to carry out a motion parallel to the axis of the shaft 28 in a given direction until the housing reaches a preestablished position, where a suitable means causes a change of the disc axis to a position complementary to the preceding position with respect to a plane orthogonal to the shaft 28. Therefore, in such conditions, and with the shaft 28 having the same sense of rotation, the disc and consequently its housing are moved in an opposite direction.

The last-described device 25 is known in the art and is sold on the market under the trade name "UHING" and represents one of the devices 25 preferably used in the machine according to the invention.

Obviously, therefore, the means for producing reciprocating movement of the arm 21 can be of various types. They are diagrammatically represented in FIG. 3 by a shaft 28 rotating in bearings 29 and 30, having races mounted on supporting structures 31 and 32 which are secured to the central support 6 between the bobbins 7 and 8, the element 33 being equivalent to the nut or the disc with a housing described hereinbefore.

In principle and in a block diagram, the device 25 must be viewed as an element which receives at its input a rotational motion and converts it at its output into a rectilinear motion, with a reversal of the sense of motion at the ends of the stroke which has a length corresponding to the distance between the flanges 26 and 27 of a bobbin 7 or 8. For example, the reversal of the sense of motion takes place when the lateral surfaces 34 and 35 of housing 33 abut against the lateral surfaces 36 and 37 of structures 31 and 32 when the distance between these latter surfaces corresponds to the distance between the bobbin flanges 26 and 27.

Figure 3:
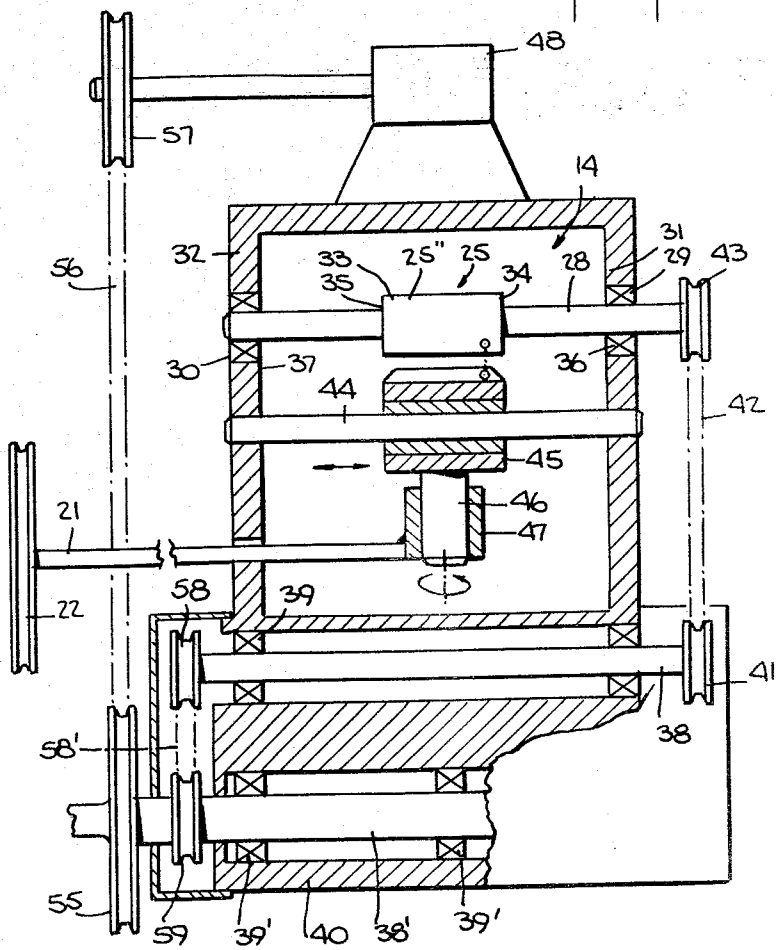
FIG. 3 illustrates in enlarged, partial cross-section the wire paying-off elements for loading the pair of bobbins shown in FIG. 2 with wire.

In the case represented in FIG. 3, the device 25 receives the rotational motion from the shaft 38, freely rotatable in the bearings 39 mounted on an extension 40 of the central support 6. Said shaft 38, rotatable by appropriate motor means, described hereinafter, imparts rotational motion to the shaft 25 by way of a pulley 41, a belt 42 and a pulley 43, secured to the shaft 28 of the device 25.

The means 25' intended to transmit to the arm 21 the rectilinear motion produced at the output of device 25 comprises a slide bar 44 parallel to shaft 28 and having its ends secured to the structures 31 and 32 and a sleeve 45 rigidly connected to the housing 33 of device 25. In turn, a pin 46 is rigidly connected at its upper part to the sleeve 45, and a collar 47, carrying the movable arm 21 in cantilever fashion, is mounted on said pin 46 so as to be rotatable around the pin 46. Said collar 47, by means of any manual or automatic system, can be rotated about the axis of pin 46 through an angle of 180°.

From the above description, it is evident how the rotational motion of shaft 28 is transformed into the rectilinear motion of arm 21 and how it is possible to employ the dispenser 14 alternatively to either bobbin 7 or 8 by the simple rotation of arm 21 around the axis of the pin 46.

Obviously, in order to guide and to lay down regularly the various wire turns in the same layer, or in superimposed layers on a bobbin, the motor means causing the rotation of shaft 38, and consequently that of shaft 28, are so adjusted as to cause a rectilinear motion of the pulleys 22 and 23 on the arm 21 which is a function of the rotational speed of the bobbin.

Said motor means can be of various kinds, and for example, they can be constituted by a drive connected to the portion of shaft 5 which passes inside the central support 6 or, according to a preferred embodiment, can be an appropriate motor 48 (FIGS. 3 and 4) not depending on the drive for the shaft 5. Motor 48 can be connected to shaft 38 by suitable gears or pulleys 58 and 59 and a belt or chain 58', as shown in FIG. 3, which will be explained with reference to the actuation of bobbins 7 and 8 in the winding-up phase, or by some other known system.

After having described the construction of the dispenser 14, it will now be easier to understand the advantages afforded by the proposed solution to the whole machine 1. First of all, the provision of an actuating mechanism for the dispenser 14 which is entirely sustained by the central support 6 and which has an overall dimension contained between the two discs 9 and 10, and the provision of an arm 21 which can be moved in a horizontal plane in proximity of either disc 9 and 10 in such a way as to insert the pulley 22 within an imaginary cylinder having said disc as a base (FIG. 4) permit, advantageously, the maintenance of the wire guiding pulley 22 as near as possible the relevant bobbin 7 or 8 during the winding-up phase, thus ensuring a perfect laying of the wire turns.

It is moreover evident that the provision of a movable arm 21 which rotates from a position in proximity of one bobbin to a position in proximity of the other bobbin by a movement carried out in a horizontal plane, together with the provision of a single actuation mechanism which does not involve changes when the bobbins pass from the stranding phase to the winding-up phase, in order not to interfere with the revolving elements performing the stranding operation, afford the further advantage of a simple and immediate adaptability of the dispenser 14 to the feeding of one bobbin or the other.

An explanation will now be given of the motion transmission system to rotate the bobbins in the winding-up phase.

Figure 2:
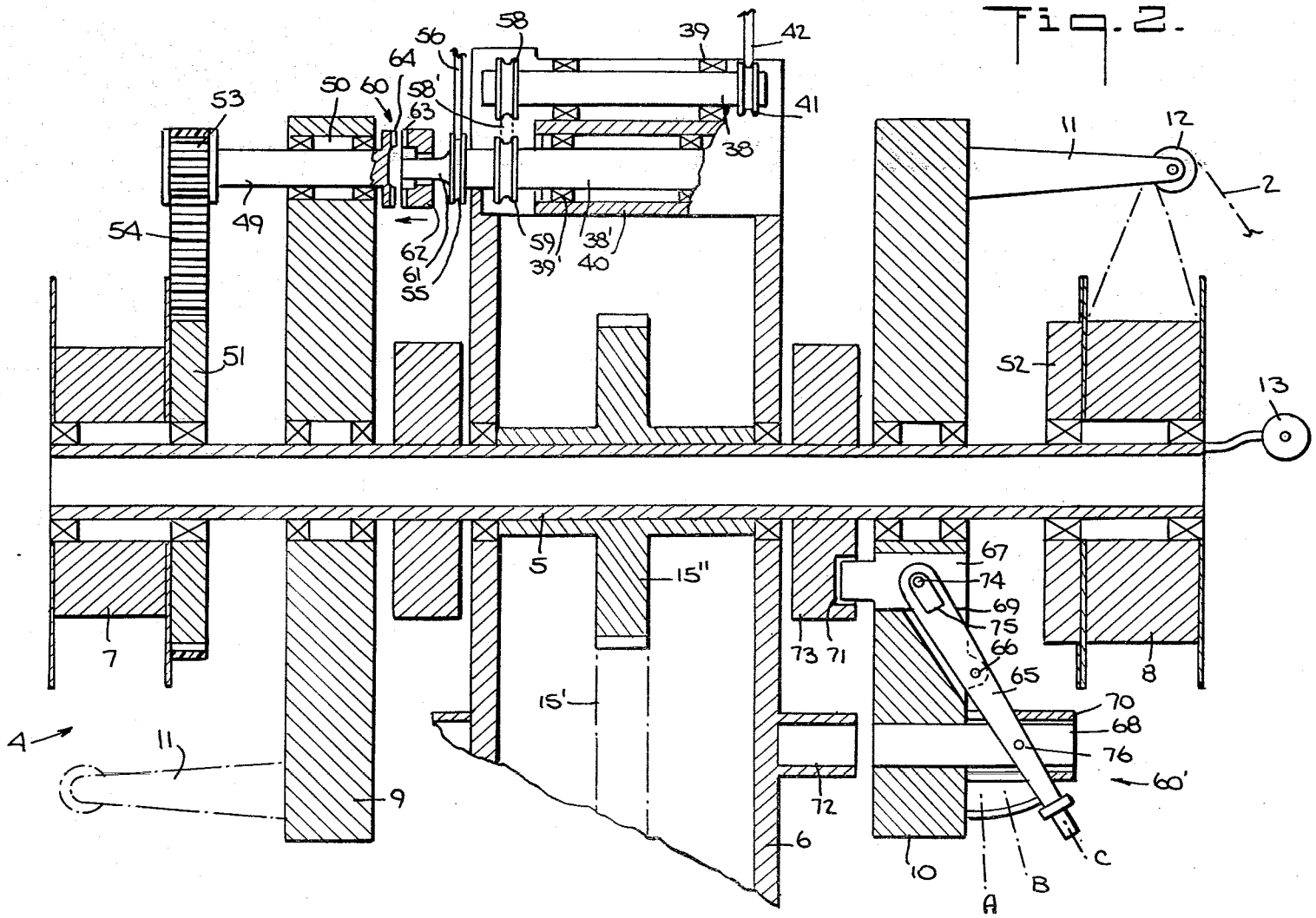
FIG. 2 is an enlarged, longitudinal cross-section of the portion of one machine part which is shown in FIG. 1 and which relates to the operation of a pair of bobbins.

Said motion transmission system comprises (FIGS. 2 and 3) a central shaft 38' rotatable on bearings 39' mounted in the extension 40 of the central support 6 and two lateral shafts 49 rotatable on bearings in seats 50 provided in the two discs (FIG. 2 shows only the shaft and seat for the disc 9, the other shaft 49 and seat 50 on the disc 10 being similar).

The lateral shafts 49 can be connected in various ways and through suitable means to the gears 51 and 52 secure to the flanges of the bobbins 7 and 8. In a preferred embodiment, it is convenient to connect permanently the free ends of the lateral shafts 49, through pulleys 53 and belts 54, to the gears 51 and 52 secured to the respective bobbin flanges (FIG. 2).

This driving connection between a lateral shaft 49 and a bobbin 7 or 8 rotates the pulley 53 when a bobbin is in the stranding phase. Said rotation may be conveniently exploited to indicate the regular paying off of the wire 2 by an appropriate apparatus, such as, for example, the apparatus described in Italian Pat. No. 959,890, assigned to the assignee of this application, modified in an obvious manner to make it appropriate for the machine of the present invention. In general, it can be said that, as long as the wire 2 is regularly paid off, the bobbin 7 or 8 and the shaft 49 rotate, and in this condition, suitable sliding contacts provided between parts of the shaft and parts fixed to the disc 9 or 10 originate a pulsating signal. When the wire breaks, the signal is interrupted or becomes continuous, and in this condition, an electric circuit, of the type described in said Italian patent, causes the machine stop to allow the necessary repairs.

In the preferred embodiment of the mechanism used to transmit motion to a bobbin in the winding-up phase, the shaft 38' is connected, by means of a pulley 55 and belts 56 (FIG. 3), to a pulley 57 of a motor 48, which is the same motor already provided to actuate the dispenser 14. In particular, the rotation of the shaft of the motor 48 is transmitted by the shaft 38' to the shaft 38 through the pulleys 58 and 58' and the belt 59, and by the shaft 38 to the shaft 28 through the pulleys 41 and 43 and the belt 42.

This driving system comprises further means 60 (FIG. 2) for the temporary connection of the central shaft 38' to the respective ends of the two lateral shafts 49 during the winding-up phase. Said means 60 for the temporary connection can be of various types and may, for example, be electromagnetic clutches or mechanical couplings, and preferably, claw clutches, able to connect the shaft 38' to the lateral shaft 49 which is to be rotated by motor 48 during the winding-up phase.

In the preferred embodiment, the shaft 38' is splined at its end 61 to receive, coaxially, a sleeve 62 which is provided with clutch recesses 63 and which is slidable axially of the shaft 38' and with respect to the spline. Each of the lateral shafts 49 comprises clutch claws or teeth 64 able to mesh mechanically with the recesses in the sleeve 62 to provide the connection between the central shaft 38' and the lateral shaft 49.

The description of the machine 1 will now be completed by explaining the third main characteristic, in addition to the dispenser 14 and the motion transmission system, namely, the alignment means 60' (FIG. 2) which permit alignment of the lateral shafts 49 with the shaft 38' before carrying out the connection by means of the clutch 60. Only the alignment means associated with the disc 10 will be described, the alignment means associated with the disc 9 being similar.

Said alignment means 60' comprise a lever 65, with a fulcrum 66 on the disc 10, which can be angularly moved in three pre-established positions A, B and C, a first slidable element 67 and a second slidable element 68 mounted on the lever 65 at opposite sides of the fulcrum 66 and with axes parallel to shaft 5 so as to be caused to slide, in accordance with the lever 65 position, in two recesses 69 and 70 in the disc 10. First and second recesses 71 and 72, having a shape corresponding respectively to the first and to the second slidable elements 67 and 68 are provided, respectively, in a flange 73 secured for rotation with the shaft 5 in an axially inner position with respect to the disc 10, and in a suitable portion of the central support 6.

To allow an easy insertion of the slidable elements 67 and 68 in the recesses, the first element 67 is connected to the lever 65 by means of a pin 74 slidably received in a slot 7 on one side of the lever 65, and the second element 68 is connected to a pin 76 slidable in a slot (not shown) on the other side of the lever 65.

In the intermediate position of the lever 65, indicated with the letter B, the elements 67 and 68 are received only in recesses 69 and 70 of the disc 10, so that the latter is freely displaceable to any angular position, and in particular, to that position in which the shaft 38' is aligned with the lateral shaft 49 mounted on the idle disc.

In the terminal position of the lever 65, indicated with the letter A, the first element 67 is in the recess 69 and the second element 68 protrudes from disc 10 and is inserted in the second recess 72 of the central support 6. In this position, the disc 10 is locked to the central support 6, and the shaft 38' is aligned with and connected to the lateral shaft 49 by means of the clutch 60, avoiding, therefore, any misalignment of the disc 10 with respect to the shaft 38' for the motion transmission in the winding-up phase.

In the other terminal position of the lever 65, indicated with the letter C, the first element 67 protrudes from the disc 10 and is received in the first recess 71 of the flange 73 fast with shaft 5, and the second element 68 is inside the recess 70 in the disc 10. This position of the lever 65 secures the disc 10 to the shaft 5 which is rotatable and permits the decoiling of the wire 2 from the bobbin 8 in the stranding phase.

Further characteristics of the invention will be now evident, after the complete description of the machine 1.

The whole actuating mechanism for the bobbins 7 and 8, namely, the shafts, is situated in the area between the two discs 9 and 10, with the exception of the end pulleys 53 of the lateral shafts 49, which are, in any event, arranged in an axially inner position with respect to the two bobbins 7 and 8. Therefore, the actuating mechanism for the bobbins 7 and 8, in the winding-up phase does not have a radial size greater than that of the discs 9 and 10 and does not involve the space between the two flanges of each bobbin 7 and 8. Consequently, the arrangement permits movement of the arm 21 and the guiding pulleys 22 and 23 to the position nearest to the bobbins on which wire is being wound, and this represents an optimum condition because of a regular winding-up of the wire and a subsequent correct operation in the stranding phase.

A further aspect of the invention is represented by the solution according to which each disc of the machine is active not only during the stranding phase but also in the winding-up phase.

In fact, the disc associated with each bobbin, besides acting as a support for the paying-off arm 11 when the disc rotates with the shaft 5 in the stranding phase, acts during the winding-up phase as a support for the alignment means 60' and a support for the lateral shaft 49 which imparts motion to the bobbin 7 or 8 in the winding-up phase.

The operation of the machine of the invention will now be described with reference to FIGS. 1–4 illustrating the constructional characteristics progressively described and with reference to FIG. 5 which is a simplified kinematic diagram.

The bobbins 7 and 7' and 8 and 8' of the two units shown in FIG. 1 operate, respectively, in the winding-up phase and in the stranding phase. In a corresponding manner, the bobbins 7 and 8 operate in the conditions illustrated in FIG. 5.

During the winding-up phase, the disc 9 of the bobbin 7 is linked to the central support 6 with an appropriately chosen orientation in order to move into a lower position the paying-off arm 11 and to allow the alignment and the connection between the central shaft 38' and the lateral shaft 49 (FIG. 2).

The bobbin 7, rotated by the motor 48, by means of the central shaft 38' and the lateral shaft 49, takes up the wire coming from the feeding drum 24 (FIG. 4), while a regulating action on the turns being formed is carried out by the dispenser 14, the shaft 28 of which transforms the rotational motion received from motor 48 into a linear motion, first in one sense, and then, in the opposite sense, of the movable arm 21 and of the pulleys 22 and 23, at a speed which has been preliminarily established in accordance with the speed of the bobbin rotation.

The winding-up of new wire 2 on bobbin 7' takes place in an analogous manner.

Figure 5:
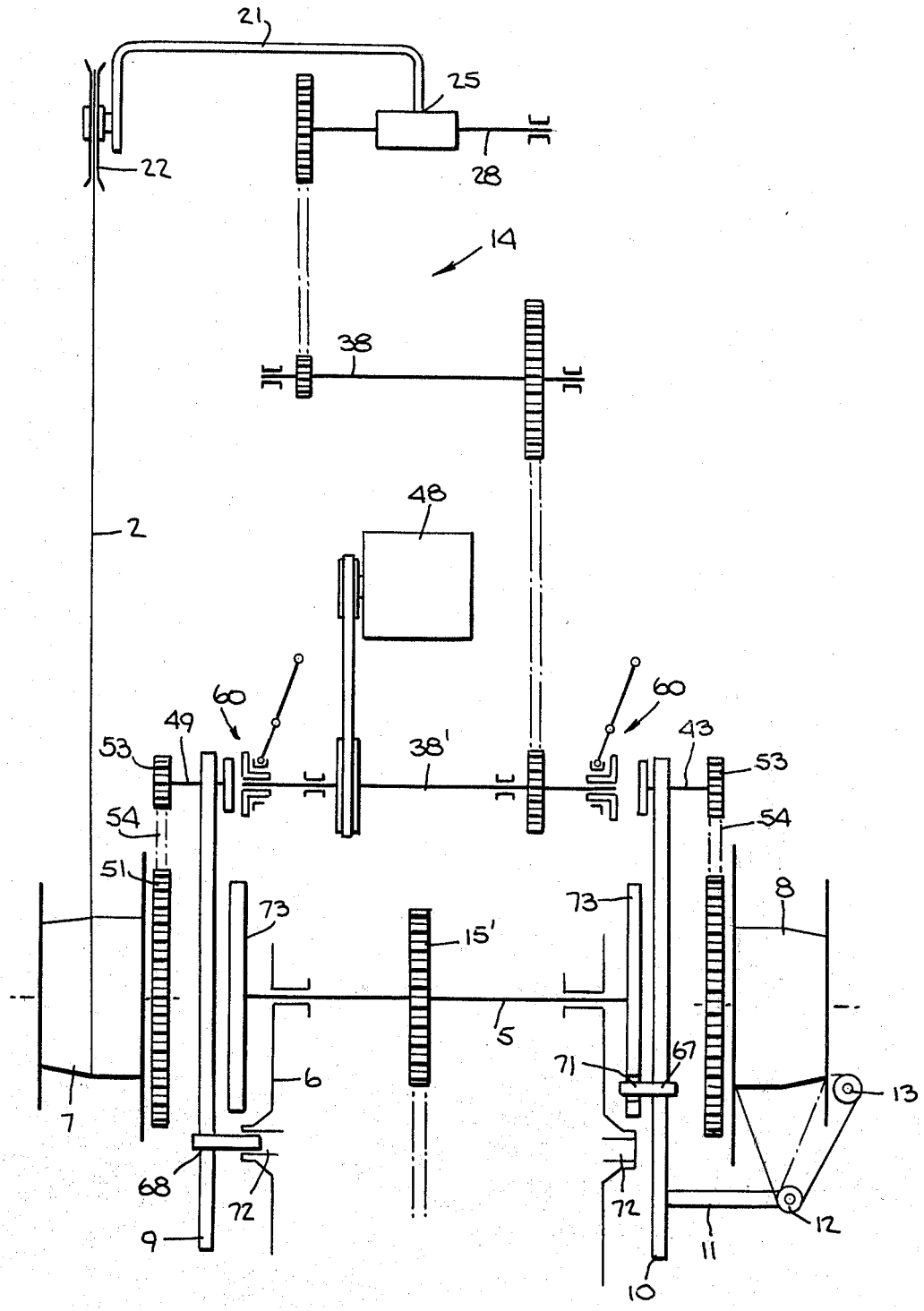
FIG. 5 is a simplified diagram used to describe the machine operation.

During the stranding phase, the disc 10 of the bobbin 8 is linked to the shaft 5 rotated by the auxiliary shaft 15 (FIG. 1), and the lateral shaft 49 on the disc 10 is disengaged from the shaft 38' on the support 6, as is diagrammatically indicated in FIG. 5.

The bobbin 8 is rotated on the shaft 5 owing to the tension exerted on the wire 2 by the tensioning means (described but not shown), and the wire 2 is guided in its passage from the outside to the inside of the shaft 5 at first on the pulley 12 on the arm 11 fast with the disc 10 and then on the return pulley 13, both pulleys rotating with the shaft 5.

The cable core 3 also passes inside the shaft 5 simultaneously with the wire 2. Said core is equally subjected to the tension exerted by the tensioning means and is directed from the paying-off stand 16, through the hollow shafts 5 of all units 4 of the machine, towards the stranding station elements 18 and 19.

The operation of the bobbin 8' during the stranding phase is analogous to that of the bobbin 8.

In the intermediate steps, the changes in the functions of the bobbins of a same unit take place as follows:

(1) With the machine at rest, the clutch means 60 between the lateral shaft 49 and the shaft 38' are actuated in such a way as to release the bobbin 7 from its connection with the motor 48.

(2) The lever 65 is moved to position C in which, as already stated, the disc 9 is ready to effect stranding, namely, is fast with shaft 5; and (3) The end of the wire of the bobbin 7 is connected to the end of the wire of the already exhausted bobbin of the adjacent unit (not shown), which is nearest to the stranding station 19.

An analogous method is followed to prepare for the stranding phase the bobbins reloaded with wire in the preceding phase in all the successive units of the machine.

Then, the operations for preparing the empty bobbin 8 for the winding-up phase are carried out as follows:

(1) At first, the brake connecting the bobbin to the disc is released; and (2) Then, the lever 65 is moved from position C to position B (FIG. 2) in order to move the disc angularly with respect to shaft 5 and to bring the lateral shaft 49 on the disc in perfect alignment with the shaft 38' situated on support 6 and the paying-off arm 11 in condition not to interfere with the position to be taken by the movable arm 21 of dispenser 14.

(3) Then, the movable arm 21 is moved by rotating, through 180°, the collar 47 about the pin 46 between the two positions in which the pulley 22 is aligned with the bobbin.

Subsequently, the disc is locked to the support by moving lever 65 to position A (FIG. 3) and the claws of the lateral shaft 49 and are caused to mesh with the claws of shaft 38' to establish a mechanical connection between the motor 48 and the bobbin 8.

At last, the wire coming from the feeding drum 24 is guided towards the driving pulleys 22 and 23 (FIG. 4) and some turns of wire are laid about the hub of bobbin 8. An analogous system is followed to prepare for the winding-up phase the empty bobbins of all the other units.

It will be noted that, during the machine operation each bobbin, during the winding-up phase, is rotated by a respective motor 48, that is, the rotation of a bobbin is independent not only of the main shaft 5 but also of the actuating mechanisms of the bobbins in the winding-up phase on the other units of the stranding machine. This characteristic gives the advantage of that winding-up of the wire on the bobbins can proceed even in the event that the shaft 5 is stopped.

The independence of the rotation of the bobbin with respect to the main shaft 5 represents a further advantage since, in the event of an irregular winding-up of the wire, requiring a possible stopping of the motor of one bobbin to carry out the necessary repairs, the other bobbins, rotatable by the respective motors, can continue their respective winding-up phase.

A further important aspect of the present invention is the possibility of front and side access to the various units which are all separated from one another. This feature is advantageous not only when the ends of wires from different bobbins of adjacent units are to be joined for the subsequent stranding phase, but also for the possibility of providing a larger space, and, therefore, of allowing easier maneuvering in the initial steps when the wire coming from the feeding drum 24 is to be applied around the pulleys of the moving arm 21 and then around the winding-up bobbin.

Although preferred embodiments of the present invention have been described and illustrated, it will be apparent to those skilled in the art that various modifications may be made without departing from the principles of the invention.

The embodiments of the invention in which an exclusive property or privilege is claimed are defined as follows:

1. A stranding machine unit for supplying wire to a stranding station, said unit comprising:

a supporting stand;

a hollow shaft rotatably mounted on said stand and extending outwardly of two opposite sides of the stand;

drive means connected to said shaft for rotating said shaft;

a first bobbin for carrying wire rotatably mounted on said shaft at one of said sides of said stand;

a second bobbin for carrying wire rotatably mounted on said shaft at the other of said sides of said stand;

first wire paying-off means rotatably mounted on said shaft intermediate said first bobbin and said stand;

means for alternately connecting said first paying-off means to said shaft for rotation therewith and disconnecting said first paying-off means from said shaft;

second wire paying-off means rotatably mounted on said shaft intermediate said second bobbin and said stand;

means for alternately connecting said second paying-off means to said shaft for rotation therewith and disconnecting said second paying-off means from said shaft;

bobbin rotating means comprising a central shaft rotatably mounted intermediate said bobbins, drive means for rotating said central shaft, a first lateral shaft rotatably mounted on said first paying-off means at a position spaced from the axis of rotation of said first paying-off means, a second lateral shaft rotatably mounted on said second paying-off means at a position spaced from the axis of rotation of said second paying-off means, clutch means for alternately connecting each said lateral shaft to and disconnecting each lateral shaft from said central shaft, whereby a lateral shaft connected to the central shaft by the clutch means is caused to rotate with the central shaft, means interconnecting said first lateral shaft with said first bobbin for causing rotation of the first bobbin with the first lateral shaft and means interconnecting said second lateral shaft with said second bobbin for causing rotation of the second bobbin with the second lateral shaft; and a wire dispenser for alternately supplying wire to said first bobbin and to said second bobbin, said wire dispenser comprising guiding means for the wire including an arm mounted for movement in a plane parallel to the axis of said hollow shaft, whereby an end of said arm may be moved from adjacent the first bobbin to adjacent the second bobbin and vice versa, and reciprocating means connected to said arm for reciprocating said end thereof parallel to the axis of said hollow shaft and for thereby laying turns of wire on a bobbin in side-by-side relation.

2. A stranding machine unit as set forth in claim 1 wherein each of said first and said second paying-off means comprises a disc rotatably mounted on said hollow shaft and a decoiling arm spaced from the axis of said hollow shaft and extending from the face of a disc toward the end of the hollow shaft nearest thereto.

3. A stranding machine unit as set forth in claim 2 wherein said paying-off means comprises a rotatable pulley for receiving wire from a bobbin and guiding it toward the inside of said hollow shaft.

4. A stranding machine unit as set forth in claim 3 wherein said pulley is rotatably mounted on said decoiling arm.

5. A stranding machine unit as set forth in claims 1 or 2 wherein said drive means for rotating said central shaft is independent of the drive means for rotating said hollow shaft.

6. A stranding machine unit as set forth in claim 2 wherein said central shaft is mounted at a predetermined distance from the axis of said hollow shaft, said first lateral shaft is mounted on one disc at said distance from the axis of said hollow shaft and said second lateral shaft is mounted on the other disc at said distance from the axis of said hollow shaft whereby a lateral shaft may be axially aligned with the central shaft by rotation of the disc on which the lateral shaft is mounted.

7. A stranding machine unit as set forth in claim 1 wherein said central shaft is connected to said reciprocating means for operating the latter.

8. A stranding machine unit as set forth in claim 1 or 7 wherein each bobbin has flanges respectively at opposite axial ends of the bobbin, wherein said reciprocating means comprises a slide bar mounted on said stand intermediate the first paying-off means and the second paying-off means, a sleeve slidably mounted on said slide bar and a reciprocating drive means mounted on said stand and connected to said sleeve for reciprocating said sleeve along a path substantially equal in length to the distance between the flanges of a bobbin and wherein said arm of the wire dispenser is mounted on said sleeve.

9. A stranding machine unit as set forth in claim 8 wherein said sleeve has a pin thereon extending perpendicularly to the axis of said slide bar and wherein said last-mentioned arm is secured at one end to a collar pivotally mounted on said pin.

10. A stranding machine unit as set forth in claim 8 wherein said reciprocating drive means comprises a rotatable shaft, means on said last-mentioned shaft for converting rotation thereof to rectilinear motion, said last-mentioned means being connected to said sleeve, means interconnecting said central shaft with said last-mentioned rotatable shaft for causing rotation of the latter by the central shaft and motor means connected to said central shaft for rotating the latter.

11. A stranding machine unit as set forth in claim 1 wherein each of said paying-off means comprises a disc rotatably mounted on said hollow shaft and wherein the lateral shafts are respectively mounted on a disc and further comprising a flange adjacent said disc and mounted on said hollow shaft for rotation therewith and control means for alternately permitting said disc to rotate freely on said hollow shaft, causing said disc to rotate with said flange and holding said disc in a fixed position with the lateral shaft therein axially aligned with the central shaft, said control means comprising a pair of slidable elements slidably mounted on said disc for movement axially of said disc, said flange having means thereon for receiving one of said elements and said stand having means thereon for receiving the other of said elements, and lever means pivotally mounted from said disc and connected to said elements for alternately engaging said one of said elements with said means on said flange for causing rotation of the disc with the flange, engaging the other of said elements with said means on said stand for receiving the other of said elements for holding the disc in a fixed position and simultaneously moving said one of said elements out of engagement with said means on said flange and said other of said elements out of engagement with said means on said stand for receiving the other of said elements and thereby permitting said disc to rotate freely on said hollow shaft.

12. A stranding machine unit as set forth in claim 1 wherin each of said paying-off means comprises a disc rotatably mounted on said hollow shaft and wherein said end of said arm is spaced from the axis of said hollow shaft by a distance not greater than the radius of said disc when said end of said arm is adjacent a bobbin.

13. A stranding machine unit as set forth in claim 12 wherein a wire guiding pulley is rotatably mounted on said end of said arm and wherein at least a portion of said pulley is spaced from the axis of said hollow shaft by a distance not greater than the radius of said disc.

14. A stranding machine unit as set forth in claim 1 in combination with a second similar stranding unit as set forth in claim 1, said second unit being disposed adjacent the first-mentioned unit with its hollow shaft axially aligned with but spaced from the hollow shaft of said first-mentioned unit.

* * * * *

UNITED STATES PATENT AND TRADEMARK OFFICE

CERTIFICATE OF CORRECTION

PATENT NO. : 4,322,941

DATED : April 6, 1982

INVENTOR(S) : Marcello Sarracino

It is certified that error appears in the above-identified patent and that said Letters Patent are hereby corrected as shown below:

Col. 8, line 30, change "7" to --75--.

Signed and Sealed this

*Seventeenth* Day of *August 1982*

[SEAL]

*Attest:*

GERALD J. MOSSINGHOFF

*Attesting Officer*

*Commissioner of Patents and Trademarks*